US007670157B2

(12) United States Patent
Miyamoto

(10) Patent No.: US 7,670,157 B2
(45) Date of Patent: Mar. 2, 2010

(54) LEVER CONNECTOR

(75) Inventor: Toshifumi Miyamoto, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 11 days.

(21) Appl. No.: 12/038,022

(22) Filed: Feb. 27, 2008

(65) Prior Publication Data

US 2008/0213038 A1 Sep. 4, 2008

(30) Foreign Application Priority Data

Mar. 2, 2007 (JP) ..... 2007-052240

(51) Int. Cl.
*H01R 13/629* (2006.01)

(52) U.S. Cl. ..... 439/157; 403/322.4

(58) Field of Classification Search ..... 403/322.4; 439/157

See application file for complete search history.

(56) References Cited

U.S. PATENT DOCUMENTS

| | | | | |
|---|---|---|---|---|
| 4,582,446 | A * | 4/1986 | Salice | 403/215 |
| 5,269,696 | A * | 12/1993 | Okada et al. | 439/140 |
| 5,509,816 | A * | 4/1996 | Katsuma | 439/157 |
| 5,603,624 | A * | 2/1997 | Taguchi et al. | 439/157 |
| 6,264,485 | B1 * | 7/2001 | Saka et al. | 439/157 |
| 6,755,674 | B2 * | 6/2004 | Fujii et al. | 439/157 |
| 6,863,463 | B2 * | 3/2005 | Matsushita | 403/322.4 |
| 7,287,993 | B2 * | 10/2007 | Fujii et al. | 439/157 |
| 7,329,133 | B2 * | 2/2008 | Ishikawa | 439/157 |
| 7,442,058 | B2 * | 10/2008 | Ohtaka et al. | 439/157 |
| 7,445,474 | B2 * | 11/2008 | Sakatani et al. | 439/157 |
| 7,476,116 | B2 * | 1/2009 | Shinozaki | 439/345 |
| 2002/0025704 | A1 * | 2/2002 | Takata | 439/157 |
| 2002/0177338 | A1 * | 11/2002 | Nishide et al. | 439/157 |
| 2006/0240693 | A1 * | 10/2006 | Nishide | 439/157 |
| 2006/0281351 | A1 * | 12/2006 | Yamaoka | 439/157 |
| 2006/0286834 | A1 * | 12/2006 | Fukatsu et al. | 439/157 |
| 2008/0032531 | A1 * | 2/2008 | Okuda et al. | 439/157 |
| 2008/0064243 | A1 * | 3/2008 | Okuda et al. | 439/157 |
| 2008/0081498 | A1 * | 4/2008 | Fukatsu et al. | 439/157 |
| 2008/0200052 | A1 * | 8/2008 | Okuda et al. | 439/157 |
| 2009/0023316 | A1 * | 1/2009 | Takahashi et al. | 439/157 |

FOREIGN PATENT DOCUMENTS

| | | |
|---|---|---|
| JP | 10-144387 | 5/1998 |

* cited by examiner

*Primary Examiner*—Daniel P Stodola
*Assistant Examiner*—Joshua T Kennedy
(74) *Attorney, Agent, or Firm*—Gerald E. Hespos; Anthony J. Casella

(57) ABSTRACT

A female housing (10) includes cam pins (14). A lever (70) is mounted on a male housing (30), and arms (73) of the lever (70) are formed with bearing portions (74) and cam grooves (71) engageable with the cam pins (14). An engaging groove (78) is formed adjacent to the cam groove (71) in each arm (73), and an engaging pin (17) is provided adjacent to each cam pin (14) on the female housing (10). The engaging grooves (78) can receive the engaging pins (17) during the rotation of the lever (70) and have inclination restricting surfaces (79) for restricting the inclination of the female housing (10) by sliding in contact with the engaging pins (17) as the lever (70) is rotated if the posture of the female housing (10) being connected is inclined relative to the female housing (30).

15 Claims, 5 Drawing Sheets

LEVER CONNECTOR

FIELD OF THE INVENTION

The invention relates to a lever-type connector.

DESCRIPTION OF THE RELATED ART

Japanese Unexamined Patent Publication No. H10-144387 discloses a lever-type connector assembly with first and second housings that are connectable with each other. A lever is mounted rotatably on the first housing and cam pins are provided on the second housing. The lever has an operable portion and two arms to define a U-shape. Cam grooves are formed in the arms and can engage with the cam pins. The cam pins move along the cam grooves as the lever is rotated and generate a cam action for connecting the housings. The arms are formed with restricting grooves and the first housing includes restricting pins. The restricting pins slide in the restricting grooves in the rotation process of the lever to prevent displacement of the arms.

A lever operating force is exerted eccentrically in an operating direction in the process of pushing the operable portion of the lever towards a connection position. Thus, there is a tendency that the connecting operation quickly proceeds at a side corresponding to the operable portion while slowly proceeding at a side opposite the operable portion. Therefore, within the range of a clearance of a dimensional tolerance formed between the two housings, the second housing is inclined from its proper connecting posture towards a side where the lever operating force acts more strongly. The inclination is maximized when the lever reaches the connection position, which might adversely affect connecting operations of terminal fittings accommodated in the two housings.

The present invention was developed in view of the above situation and an object thereof is to connect two connector housings in proper postures.

SUMMARY OF THE INVENTION

The invention relates to a lever-type connector comprising first and second housings that are connectable with each other. A lever is mounted movably on the first housing and can be displaced from an initial position to a connection position. The lever includes at least one arm formed with at least one cam groove. At least one cam pin is provided on the second housing and can fit into the cam groove. Rotation of the lever generates a cam action between the cam pin and the cam groove for urging the housings towards or away from one another. The arm of the lever also has an engaging groove adjacent to the cam groove and the second housing has at least one engaging pin adjacent to the cam pin. The engaging groove can receive the engaging pin during the operation of the lever. The engaging groove has at least one inclination restricting surface that slides in contact with the engaging pin as the lever is displaced for restricting the inclination of the second housing if the posture of the second housing is inclined relative to the first housing.

The lever operating force exerted on the lever in the process of connecting the housings can cause the second housing to incline. However, the engaging pin will slide along the inclination restricting surface of the engaging groove as the lever is rotated to limit the inclination. Therefore, the two housings can be connected in correct postures when the lever reaches the connection position.

The engaging pin preferably slides on the inclination restricting surface only if the posture of the second housing is inclined relative to the first housing. Conversely, the engaging pin does not slide on the inclination restricting surface of the engaging groove unless the second housing is inclined. Thus, no additional frictional force results from the sliding contact and an increase of the lever operating force can be suppressed.

The engaging groove preferably receives the engaging pin when the lever is rotated from the initial position approximately halfway towards the connection position. Thus, the inclination of the second housing can be restricted before it becomes large and the extending length of the engaging groove need not be increased unnecessarily.

The cam groove and the engaging groove preferably are bottomed grooves in the arm and preferably are connected with each other in an extending direction thereof. Thus, the arm is assured of being sufficiently strong.

The engaging groove preferably is slightly narrower than the cam groove and/or shallower than the cam groove.

The back end of the engaging groove preferably is parallel to the forward and backward directions when the lever is at the connection position.

The inclination restricting surface preferably is not concentric with the cam-pin sliding surface of the cam groove.

The center of the inclination restricting surface preferably is at a position different from the center of a bearing portion of the lever.

The second housing preferably comprises at least one elongated rib extending substantially in forward and backward directions and the first housing comprises at least one rib introducing groove for receiving the elongated rib during connection of the two housings.

Lateral ends of the engaging pin and the rib preferably are near each other and are substantially parallel.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
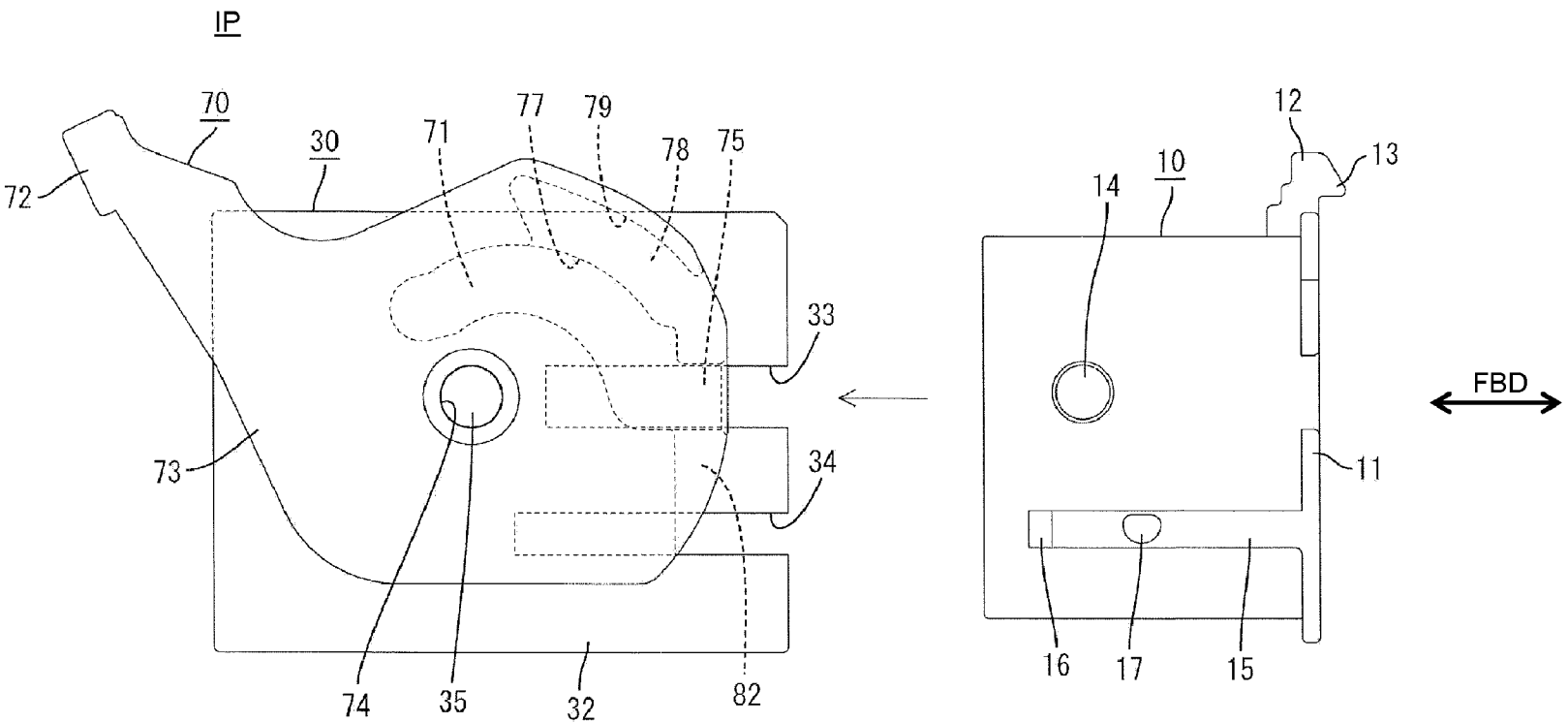
FIG. 1 is a side view of one embodiment showing a state before two housings are connected with a lever held at an initial position.

One preferred embodiment of the present invention is described with reference to FIGS. 1 to 5. This embodiment is provided with at least one pair of male and female housings connectable with and separable from each other, and a lever 70 that is rotatable between an initial position IP and a connection position CP. In the following description, ends of the two housings to be connected are referred to as front ends concerning forward and backward directions FBD and reference is made to FIG. 1 concerning the vertical direction.

The female housing 10 is made e.g. of a synthetic resin and is substantially in the form of a rectangular block. Female terminal fittings (not shown) are accommodated in the female housing 10 and a flange 11 project out near the rear end of the female housing 10.

An interlocking portion 12 projects near the rear end of the upper surface of the female housing 10. The interlocking portion 12 is stepped to be elevated towards the back side, and a claw-shaped hookable portion 13 projects back from the rear end thereof. The lever 70 may be engaged resiliently with the hookable portion 13 upon reaching the connection position CP.

Substantially cylindrical cam pins 14 project on the opposite side surfaces of the female housing 10. An outer peripheral edge of the projecting end of each cam pin 14 is beveled or rounded over substantially the entire circumference and is displaced up to the front from a central position of the corresponding side surface in height and width directions. The cam pins 14 can fit into cam grooves 71 in the lever 70 and are movable along the cam grooves 71 as the lever 70 is rotated.

Left and right elongated ribs 15 extend in forward and backward directions FBD on the opposite side surfaces of the female housing 10. The ribs 15 are located lower than the centers of the respective side surfaces in the height direction, which is a direction substantially normal to the forward and backward directions FBD. The front ends of the ribs 15 are retracted slightly from the front ends of the respective side surfaces while the rear ends of the ribs 15 are connected unitarily with the front surface of the flange 11. Slanted guiding surfaces 16 are formed at the front ends of the outer surfaces of the ribs 15 to facilitate a smooth connecting operation of the two housings 10, 30.

Left and right engaging pins 17 project adjacent to the cam pins 14 at positions slightly before the central positions of the outer surfaces of the respective ribs 15 in substantially forward and backward directions FBD. The engaging pins 17 are lower than the cam pins 14 in the height direction and more backward from the cam pins 14 in forward and backward directions FBD. Specifically, the engaging pins 17 have a smaller substantially cylindrical shape than the cam pins 14, and the cross section thereof is substantially half-moon shaped. The upper and lower ends of the engaging pins 17 are at short distances to the upper and lower ends of the ribs 15, and the upper ends of the engaging pins 17 and those of the ribs 15 are substantially parallel to each other.

The male housing 30 is made e.g. of a synthetic resin and includes a terminal accommodating portion 31 substantially in the form of a rectangular block and a substantially rectangular tubular receptacle 32 projects forward from the peripheral edge of the front surface of the terminal accommodating portion 31. Tab-shaped male terminal fittings (not shown) are mounted in the terminal accommodating portion 31, and the leading ends of the male terminal fittings project into the receptacle 32. The female housing 10 can be fit into the receptacle 32, and the opening edge at the front end of the receptacle 32 is in contact with the front surface of the flange 11 with the two housings, 10, 30 properly connected.

The receptacle 32 is formed with cam-pin introducing grooves 33 for receiving the respective cam pins 14 when connecting the housings 10, 30. The cam-pin introducing grooves 33 are at least as wide as the diameter of the cam pins 14 and extend in forward and backward directions FBD from the opening edge of the receptacle 32 towards the back of the receptacle 32. The receptacle 32 also has rib introducing grooves 34 for receiving the ribs 15 when connecting the two housings 10, 30. The rib introducing grooves 34 have widths at least equal to the width of the ribs 15 and extend in forward and backward directions FBD from the opening edge of the receptacle 32 towards the back surface of the receptacle 32 substantially in parallel with the cam-pin introducing grooves 33. The back ends of the rib introducing grooves 34 are more backward than the back ends of the cam-pin introducing grooves 33. The ribs 15 inserted into the rib introducing grooves 34 have a height substantially equal to the thickness of the receptacle 32 (depth of the rib introducing grooves 34) and reinforce the engaging pins 17 while complementing the projecting height of the engaging pins 17, thereby preventing the engaging pins 17 from being broken at intermediate positions and guiding the connecting operation of the two housings 10, 30.

Left and right cylindrical supporting shafts 35 project on the opposite side surfaces of the male housing 30. The supporting shafts 35 are located substantially at boundary positions between the terminal accommodating portion 31 and the receptacle 32 in forward and backward directions FBD and at substantially the same positions as the cam-pin introducing grooves 33 in the height direction.

Figure 5:
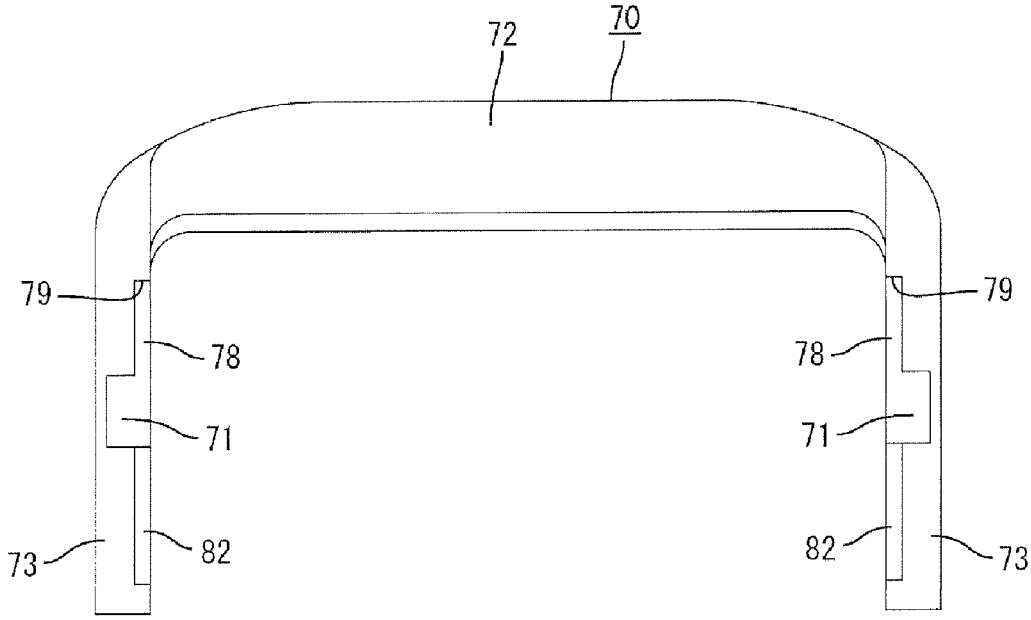
FIG. 5 is a front view of the lever.

The lever 70 also is made e.g. of a synthetic resin and has an operable portion 72 that is narrow and long in the width direction. Substantially parallel arms 73 project from opposite ends of the operable portion 72 to define a U-shape, as shown in FIG. 5. An unillustrated lock is provided on the operable portion 72 and engages the interlocking portion 12 when the lever 70 reaches the connection position CP. Thus, the lever 70 may be interlocked with the female housing 10 and the two housings 10, 30 are locked via the lever 70.

The arms 73 are substantially flat plates and substantially round bearings 74 penetrate the arms 73 in the thickness direction substantially in the centers of the arms 73. The arms 73 are deformed to widen the spacing therebetween so that the lever 70 can be mounted on the supporting shafts 35. The supporting shafts 35 then are inserted into the bearings 74. Thus, the lever 70 is rotatable about the bearings 74 and the supporting shafts 45.

A bottomed cam groove 71 is formed in the inner surface of each arm 73 and has an entrance at the outer peripheral edge of the arm 73 for receiving the cam pin 14. The cam groove 71 is comprised of a substantially straight section 75 extending straight from the entrance towards the bearing 74 and an arcuate section 76 extending from the extending end of the straight section 75 while substantially describing an arc or spiral around the bearing 74. A cam-pin sliding surface 77 is defined at the side surface of the arcuate section 76 more distant from the bearing 74 and slidably engages the cam pin 14 during rotation of the lever 70.

Figure 2:
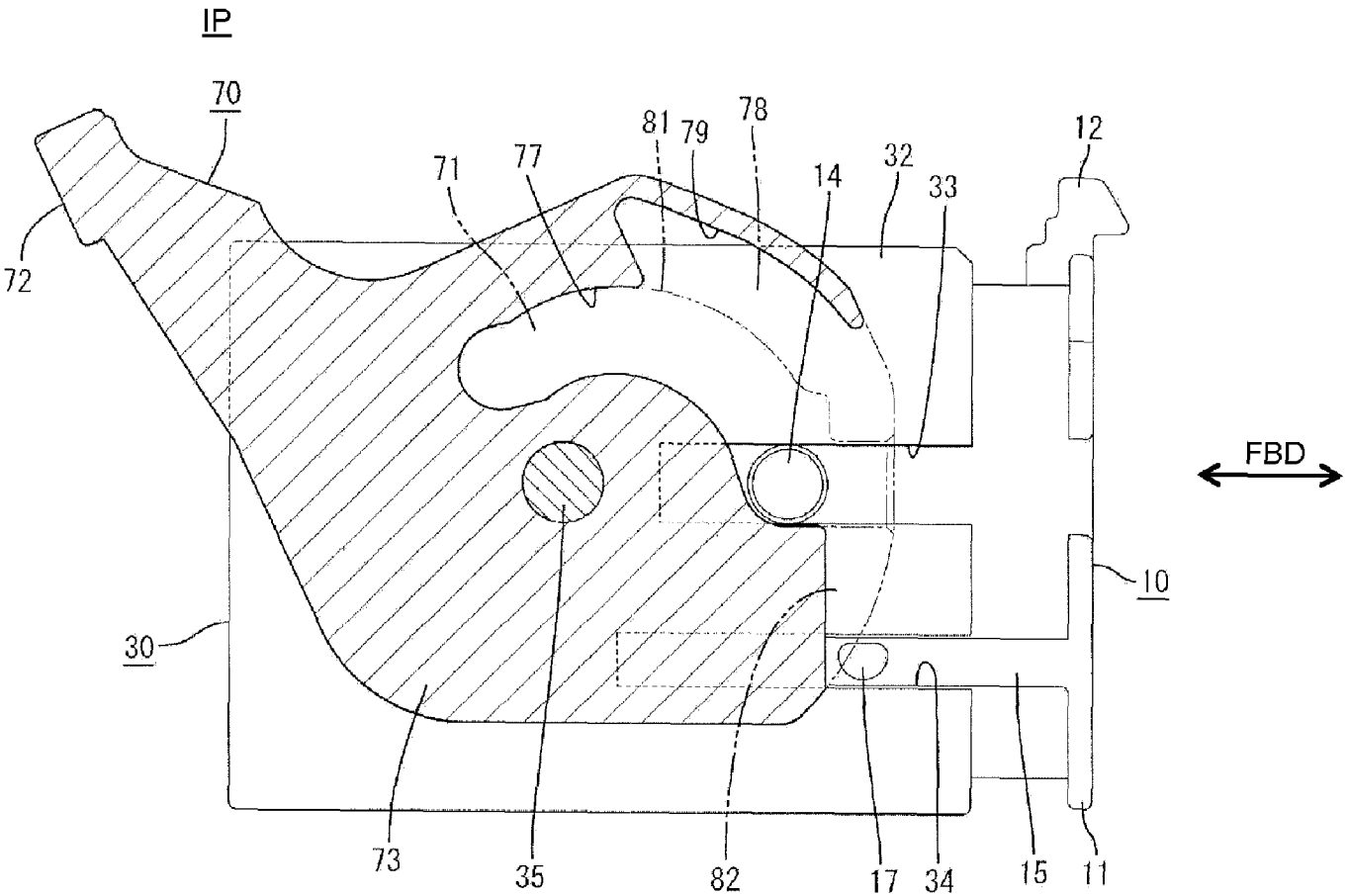
FIG. 2 is a side view partly in section showing a state where the two housings are loosely fitted with the lever held at the initial position.
Figure 4:
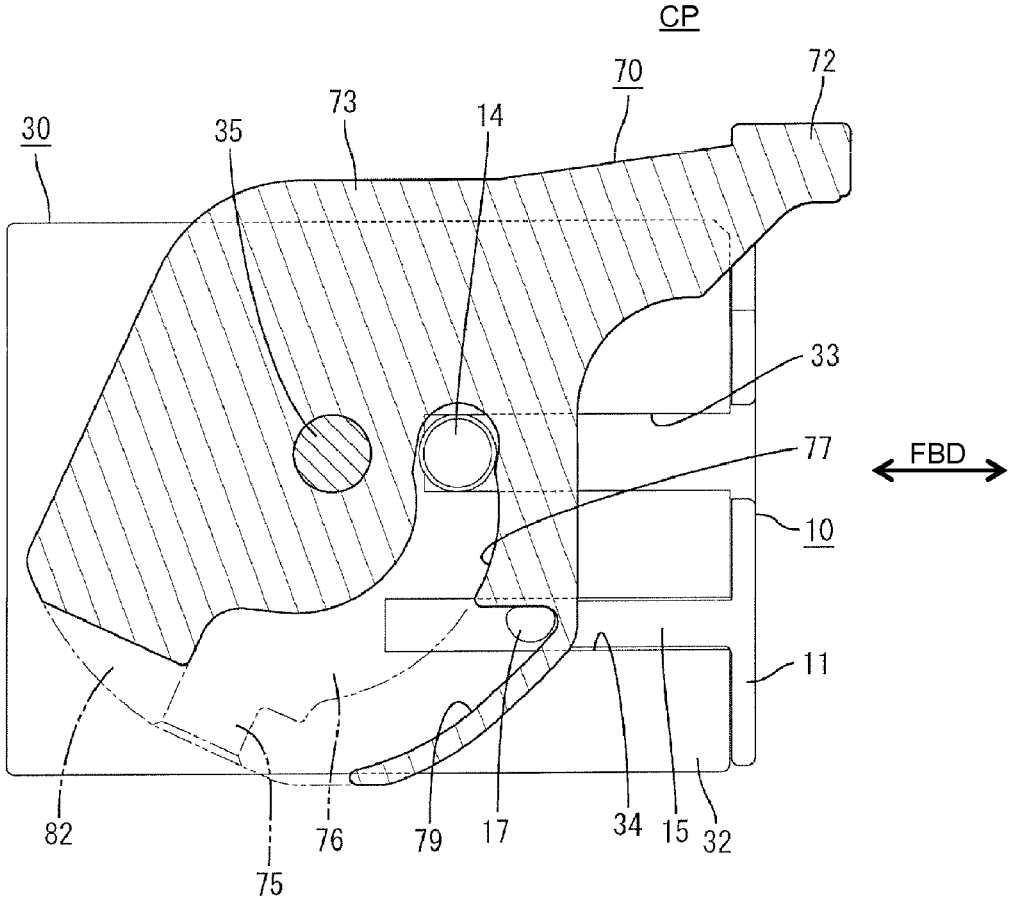
FIG. 4 is a side view in section showing a state where the two housings are properly connected by bringing the lever to the connection position.

The lever 70 can be positioned at the initial position IP on the male housing 30 where the operable portion 72 is outward of the rear end of the male housing 30 and the entrances of the cam grooves 71 face forward, as shown in FIG. 2. The lever 70 also can be rotated to the connection position CP on the male housing 30 where the operable portion 72 is outward of the front end of the male housing 30 to face the interlocking portion 12 with the entrances of the cam grooves 71 facing down, as shown in FIG. 4.

A bottomed engaging groove 78 is formed adjacent to the cam groove 71 in the inner surface of each arm 73. The engaging groove 78 is arcuate and extends substantially parallel to the cam groove 71. The entrance of the engaging groove 78 opens at the outer peripheral edge of the arm 73, and the engaging pin 17 is insertable into the engaging groove 78 through this entrance. Specifically, the engaging groove 78 is at the same side as the cam groove 71 with respect to the bearing 74 of the arm 73 and more distant from the bearing 74 than the cam groove 71. Additionally, the engaging groove 78 is shorter than the cam groove 71.

The engaging groove 78 is slightly narrower than the cam groove 71 and shallower than the cam groove 71. Thus, a step 81 is defined between the bottom surface of the engaging groove 78 and the bottom surface of the cam groove 71 on the inner surface of each arm 73. The back end of the engaging groove 78 is substantially horizontal and parallel to the forward and backward directions FBD when the lever 70 is at the connection position CP. An inclination restricting surface 79 is defined at the side surface of the engaging groove 78 more distant from the bearing 74 and slides in contact with the engaging pin 17 during rotation of the lever 70 for restricting an inclination of the female housing 10 relative to the male housing 30. The inclination restricting surface 79 extends substantially parallel to the outer peripheral edge of the arm 73 near this outer peripheral edge, and has an extending direction set to gradually correct an inclined posture of the female housing 10 or to restrict any further inclination of the female housing 10 as the rotation of the lever 70 proceeds. An arc defining the inclination restricting surface 79 is not concentric with the arc defining the cam-pin sliding surface 77 and the center of the inclination restricting surface 79 is at a position different from the center of the bearing 74.

An escaping portion 82 for the engaging pin 17 is formed in the inner surface of each arm 73 and crosses the entrances of the engaging groove 78 and the cam groove 71 in the height direction when the lever 70 is at the initial position IP. The engaging pin 17 is in the escaping portion 82 up to an intermediate position representing about half of the rotational movement of the lever 70 from the initial position IP towards the connection position CD to avoid interference with the arm 73. the lever 70 is in a substantially vertical posture at the intermediate position IP. The engaging pin 17 then enters the engaging groove 78 and slides on the inclination restricting surface 79 from this intermediate position on. The engaging pin 17 contacts the back end of the engaging groove 78 as the lever 70 reaches the connection position CP.

The lever 70 is mounted on the male housing 30 and is positioned at the initial position IP. At the initial position IP, as shown in FIG. 1, the straight sections 75 including the entrances of the cam grooves 71 communicate with the entrances of the cam-pin introducing grooves 33 in the thickness direction, ends of the escaping portions 82 communicate with the entrances of the rib introducing grooves 34 in thickness direction, and the straight sections 75, the cam-pin introducing grooves 33, the bearing portions 74 and the supporting shafts 35 are arranged substantially side by side on a horizontal straight line in forward and backward directions FBD.

The female housing 10 then is fit partly into the receptacle 32 in a direction of the arrow shown in FIG. 1. The cam pins 14 reach the back ends of the straight sections 75 and the engaging pins 17 are inserted into the ends of the escaping portions 82 when the female housing 10 is fit loosely into the receptacle 32, as shown in FIG. 2. The operable portion 72 then is moved to rotate the lever 70 towards the connection position CP. The cam pins 14 move along the cam-pin sliding surfaces 77 in the arcuate sections 76 of the cam grooves 71 during the rotation and approach the back ends of the arcuate sections 76. Additionally, the engaging pins 17 move in the escaping portions 82 and towards the engaging grooves 78.

The upper side of the female housing 10 close to the operable portion 72 tends to be connected at a faster speed as the lever 70 is rotated, whereas the lower side of the female housing 10 distant from the operable portion 72 tends to be connected at a slower speed. Thus, there are cases where the female housing 10 is in a forward inclined posture relative to the male housing 30 so that the upper part thereof projects forward relative to a vertical axis within the range of the clearance of the dimensional tolerance between the two housings 10, 30.

Figure 3:
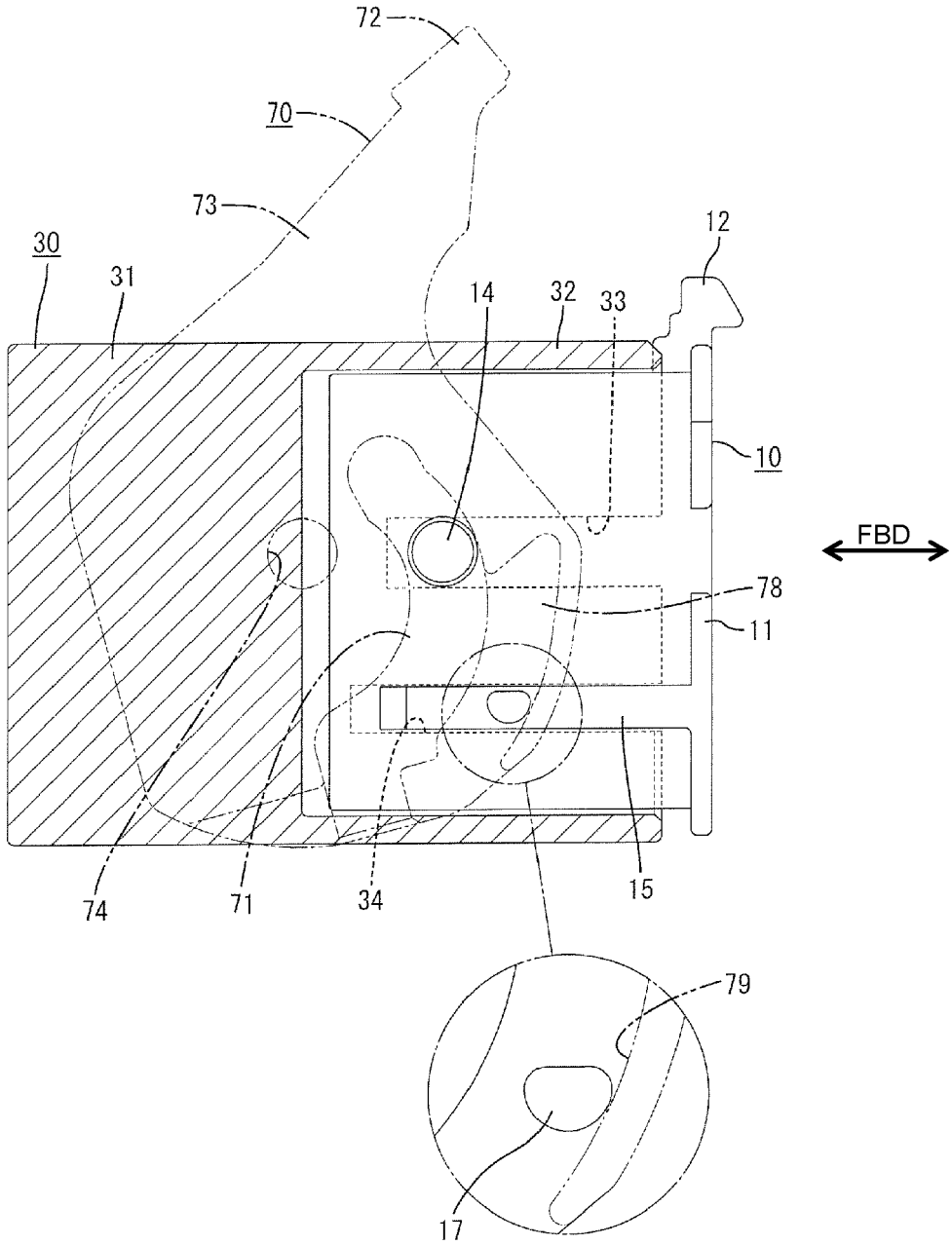
FIG. 3 is a side view partly in section showing an intermediate state when the lever is rotated toward a connection position.

The engaging pins 17 reach the receiving positions and enter the entrances of the engaging grooves 78 when the female housing 10 starts inclining in this way. Further rotation of the lever 70 causes the engaging pins 17 slide on the inclination restricting surfaces 79 of the engaging grooves 78, as shown in FIG. 3. Accordingly, a forward pushing force is exerted on the engaging pins 17 to speed up the connecting speed of the lower side of the female housing 10. Consequently, the inclined posture of the female housing 10 is corrected gradually. The cam pins 14 reach the back ends of the cam grooves 71 and the engaging pins 17 reach the back ends of the engaging grooves 78 when the lever 70 reaches the connection position CP, as shown in FIG. 4. The lock of the lever 70 then hooks the interlocking portion 12 of the female housing 10 to lock the two housings 10, 30 together. At this time, the female housing 10 is in a proper connecting posture so that the front surface of the female housing 10 is in substantially face to face contact with the back surface of the receptacle 32, and the terminal fittings in the two housings 10, 30 are connected electrically in proper connecting postures. On the other hand, if the connecting operation proceeds without inclining the female housing 10, the engaging pins 17 having entered the engaging grooves 78 are kept separated from the inclination restricting surfaces 79 and the two housings 10, 30 are connected properly while being kept in correct connecting postures.

The engaging pins 17 slide on the inclination restricting surfaces 79 of the engaging grooves 78 if the female housing 10 inclines relative to the male housing 30 while connecting the housings 10, 30. Thus, an inclination of the female housing 10 is corrected, and the housings 10, 30 are connected in correct postures when the lever 70 reaches the connection position CP. The engaging pins 17 slide on the inclination restricting surface 79 of the engaging grooves 78 only if the female housing 10 inclines during the connection. Therefore, no additional frictional force results from the sliding contact and the lever 70 can be operated easily.

The engaging grooves 78 receive the engaging pins 17 when the lever 70 is rotated approximately halfway from the initial position IP towards the connection position CP. Thus, inclination of the female housing 10 can be restricted before becoming large and the extending length of the engaging grooves 78 need not be increased, thereby ensuring a necessary strength of the arms 73.

In a situation where each arm 73 is formed with a cam groove 71 and an engaging groove 78, both the cam groove 71 and the engaging groove 78 are bottomed grooves connected in their extending direction by a step. Therefore, the arms 73 can be sufficiently strong without being made larger.

The invention is not limited to the above described and illustrated embodiment. For example, the following embodiments are also embraced by the technical scope of the invention as defined by the claims.

It is sufficient if the engaging pins slide on the inclination restricting surface of the engaging grooves to restrict any further inclination of the female housing, and the inclination of the female housing may not necessarily have been corrected completely until the two housings are connected properly.

The cam grooves and the engaging grooves may be separated from each other in the arm portions.

At least one of the cam grooves or the engaging grooves may penetrate the arms in thickness directions.

The lever may be in the form of a single plate as a whole by having one arm portion and an operable portion.

The lever may be mounted on the female housing, and the male housing may be formed with the cam pins and the engaging grooves.

The engaging grooves and the cam grooves may have the same depth. Alternatively, the engaging grooves may be deeper than the cam grooves.

The lever may be operated along paths being different from an arc, and may be operated along other paths such as a substantially linear path like a slider.

What is claimed:

1. A lever connector, comprising:

first and second housings connectable with each other, and a lever movably mountable on the first housing, the lever including at least one arm formed with at least one bottomed cam groove, the lever being displaced from an initial position towards a connection position, at least one cam pin on the second housing and being fit into the cam groove for assisting a connecting operation of the two housings as the lever is displaced, wherein:

the arm is formed with a bottomed engaging groove connected to the cam groove in the extending direction by a step and the first housing includes at least one engaging pin adjacent to the cam pin, and the engaging groove being disposed and configured for receiving the engaging pin during operation of the lever and has at least one inclination restricting surface facing substantially toward the cam groove for restricting inclination of the first housing relative to the second housing by being brought substantially into sliding contact with the engaging pin as the lever is displaced if the posture of the second housing being connected is inclined relative to the first housing.

2. The lever connector of claim 1, wherein the engaging pin slides on the inclination restricting surface only if the posture of the second housing is inclined relative to the first housing.

3. The lever connector of claim 1 wherein a receiving position where the engaging groove is disposed to receive the engaging pin when the lever is displaced approximately halfway from the initial position towards the connection position.

4. The lever connector of claim 1, wherein the cam groove and the engaging groove are connected with each other in an extending direction thereof.

5. The lever connector of claim 1, wherein the engaging groove is slightly narrower and less deep than the cam groove.

6. The lever connector of claim 1, wherein the back end of the engaging groove has a back end aligned substantially parallel to forward and backward directions when the lever is at the connection position.

7. The lever connector of claim 1, wherein the inclination restricting surface is not concentric with a cam-pin sliding surface of the cam groove.

8. The lever connector of claim 1, wherein the inclination restricting surface has a center at a position different from the center of a bearing of the lever.

9. The lever connector of claim 1, wherein the second housing comprises at least one elongated rib extending substantially in forward and backward directions and the first housing comprises at least one rib introducing groove for receiving the elongated rib during connection of the two housings.

10. The lever connector of claim 9, wherein lateral ends of the engaging pin and the rib are substantially parallel to each other and near each other.

11. A lever connector, comprising:

a first housing having at least one support shaft;

a lever formed with at least one arm rotatably mounted on the support shaft for rotation between an initial position and a connection position, the arm being formed with a cam groove and an engaging groove adjacent to the cam groove and outwardly from the cam groove relative to the support shaft, the engaging groove having an inclination restricting surface facing inwardly substantially towards the support shaft;

a second housing connectable with the first housing, the second housing having at least one cam pin movable in the cam groove as the lever is rotated for assisting a connecting operation of the first and second housings, the second housing further having at least one engaging pin disposed and configured for entering the engaging groove when the lever is rotated approximately halfway from the initial position towards the connection position and sliding in the engaging groove as the lever is rotated, the engaging pin being slidably engageable against the inclination restricting surface of the engaging groove if the female housing inclines during the connection for restricting inclination of the first housing relative to the second housing during connection of the housings.

12. The lever connector of claim 11, wherein the arm has a substantially plate shape, the cam groove and the engaging groove extending only partly into one surface of the plate-shaped arm.

13. The lever connector of claim 11, wherein the cam groove is deeper and wider than the engaging groove.

14. The lever connector of claim 13, wherein a cam-pin sliding surface is defined as a step between the cam groove and the engaging groove, the cam-pin sliding surface and the inclination restricting surface being non-concentric relative to one another.

15. The lever connector of claim 14, wherein the second housing comprises at least one elongated rib extending substantially along a connecting direction of the housings and the first housing comprises at least one rib introducing groove for receiving the elongated rib during connection of the two housings.

* * * * *